US009366000B1

(12) United States Patent
Tucker

(10) Patent No.: US 9,366,000 B1
(45) Date of Patent: Jun. 14, 2016

(54) MODULAR RETAINING WALL SYSTEM

(71) Applicant: Kenneth G Tucker, Cazadero, CA (US)

(72) Inventor: Kenneth G Tucker, Cazadero, CA (US)

( * ) Notice: Subject to any disclaimer, the term of this patent is extended or adjusted under 35 U.S.C. 154(b) by 0 days.

(21) Appl. No.: 14/549,747

(22) Filed: Nov. 21, 2014

(51) Int. Cl.
*E02D 29/02* (2006.01)
*E02D 5/76* (2006.01)

(52) U.S. Cl.
CPC ..... *E02D 29/025* (2013.01); *E02D 5/76* (2013.01); *E02D 29/02* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,324,508 | A | 4/1982 | Hilfiker et al. | |
| 4,329,089 | A | 5/1982 | Hilfiker et al. | |
| 4,391,557 | A | 7/1983 | Hilfiker et al. | |
| 4,613,255 | A | 9/1986 | Bruer | |
| 4,643,618 | A | 2/1987 | Hilfiker | |
| 4,661,023 | A | 4/1987 | Hilfiker | |
| 4,671,706 | A | 6/1987 | Giardini | |
| 4,856,939 | A | 8/1989 | Hilfiker | |
| 5,028,172 | A | 7/1991 | Wilson et al. | |
| 5,163,261 | A | 11/1992 | O'Neill | |
| 5,435,669 | A * | 7/1995 | Weber | E02D 29/025 405/284 |
| 5,487,623 | A | 1/1996 | Anderson et al. | |
| 5,540,525 | A | 7/1996 | Miller et al. | |
| 5,568,999 | A * | 10/1996 | Egan | E02D 29/0241 405/262 |
| 5,642,968 | A | 7/1997 | Anderson et al. | |
| 6,764,252 | B2 | 7/2004 | Banting | |
| 7,140,809 | B1 | 11/2006 | Braun | |
| 8,246,274 | B1 | 8/2012 | Hall et al. | |
| 8,596,928 | B1 | 12/2013 | Justiniano | |
| 2009/0148242 | A1 * | 6/2009 | Collet | B28B 7/0029 405/286 |

* cited by examiner

*Primary Examiner* — Benjamin Fiorello
*Assistant Examiner* — Kyle Armstrong
(74) *Attorney, Agent, or Firm* — Steven A. Nielsen; www.NielsenPatents.com

(57) ABSTRACT

A modular retaining wall system 100 comprises a reinforcement frame structure 700 supporting a retaining member 105, buttress 300, impact pad 500 and foot component 400. The buttress may contain a trumpet pipe 750 attached to a faceplate 755. The trumpet pipe and faceplate may be used to secure a post tension cable within the retaining wall system. The trumpet pipe may also retain accessory components such as guard rail supports. The modular retaining walls may be placed side by side and secured together by use of a pin and rod system. A second tier embodiment 200 may be secured to the top of the first embodiment 100. The impact pad 500 faces toward the hillside and protects the system from falling rocks and debris allowing for the use of native soil for backfill.

4 Claims, 14 Drawing Sheets

MODULAR RETAINING WALL SYSTEM

BACKGROUND OF THE INVENTION

(1) Field of the Invention

The invention generally relates to earth filled retaining wall systems. More particularly, the invention relates to the use of modular components to retain soil in a configuration consistent with surrounding topography.

BRIEF SUMMARY OF THE INVENTION

The present invention overcomes shortfalls in the related art by presenting an unobvious and unique combination, configuration and use of components that include a buttress attached to a retaining component with the buttress containing a trumpet pipe and bracket. A cable or post tension cable may be retained within the trumpet pipe with the cable secured within the hillside. Guard rails and other accessories may or may not be added to the face of the system.

A modular retaining wall system may further comprise an impact pad and foot component with the foot component having angled side edges allowing the retaining walls to be placed alongside one another at any needed angle. Thus, the disclosed units may be used to support roadsides in a manner following the contours of the road or surrounding topography.

Disclosed wedge connectors allow for installation of retaining units upon uneven surfaces. The wedge connectors are asymmetric, having a wide end and an narrow end and can help angle or secure an adjoining retaining wall in either an upward or downward slant.

Retaining wall components may be fabricated onsite, saving transportation costs and inventory costs. Retaining wall components may be installed in horizontal rows and stacked vertically in tiers. Part of the installation or construction process may include the use of native soils or rocks to backfill rear sections. Disclosed components may be laid side by side and may lock together with a pin and loop system to comprise a mortarless attachment system.

A disclosed top tier embodiment has a unique buttress configuration to accept the retaining component of a lower retaining wall unit.

REFERENCE NUMERALS IN THE DRAWINGS

Figure 1:
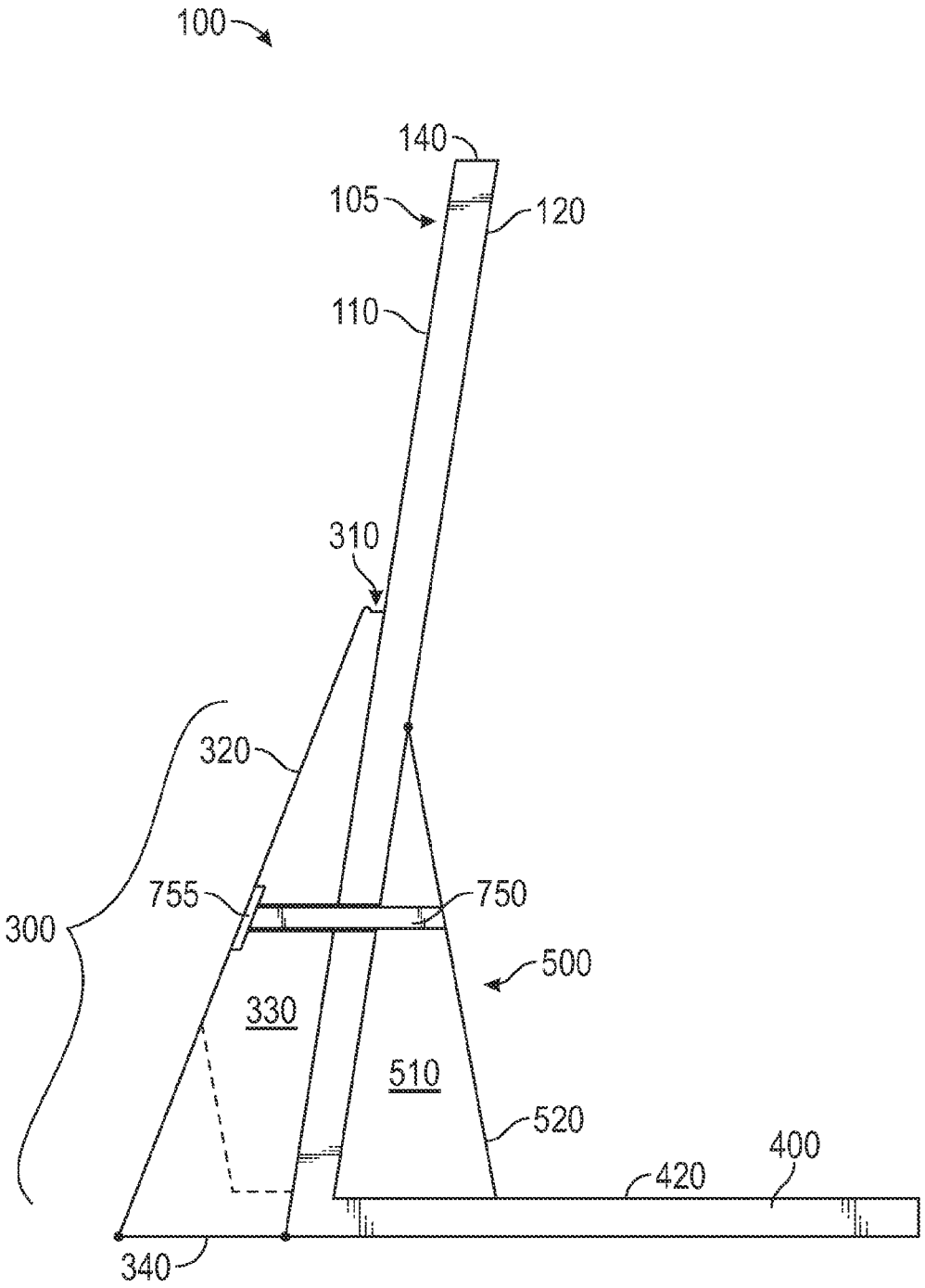
FIG. 1 depicts a sectional view of a disclosed embodiment

100 a disclosed embodiment in general
105 retaining component
110 front side of retaining component, sometimes facing down hill
120 back side of retaining component, adjacent to hillside
130 vertical sides or lateral sides of retaining component 105
140 horizontal top edge or top ledge of retaining component
150 void within and defined by retaining component sometimes used for trumpet pipe
170 corner embodiment
180 front facing component of corner embodiment 170
183 vertical ridge adjoining the front facing component 180 and the return component 185
185 return component
187 buttress of corner embodiment
200 second tier embodiment
210 raised lower footing of buttress component 230 or second tier embodiment
220 angled lower edge of buttress component 230
225 angle between raised lower footing 210 and angled lower edge 220
230 buttress component of second tier embodiment
235 angle between angled lower edge 220 and slant edge 240
240 slant edge of buttress component 230
250 void within and defined by the buttress component 230
260 lower exposed face section of retaining component
300 buttress component of the first tier embodiment 100
310 top edge of buttress component
320 slant edge of buttress component
330 side wall of buttress component
340 flat bottom side of buttress component
350 buttress void, defined within the buttress component
400 foot component
410 inward angle of foot component
420 top horizontal surface of foot component
430 angled side edges of foot component
440 back side edge of foot component
500 impact pad or reinforcing member
510 triangle side surface of impact pad
520 slanted exposed surface of impact pad
550 void within and defined by impact pad
600 wedge connector
610 front surface of wedge connector
620 back surface of wedge connector
630 angled side surface of wedge connector
633 pin rings of angled side surface 630
635 pin ring voids defined within pin rings 633
640 smaller end surface of wedge connector
645 larger end surface of wedge connector
700 reinforcement frame structure
710 retaining component frame members
715 form saver Z shaped bar
717 form saver threaded components

720 buttress component frame members
725 rebar stirrups
730 foot component frame members
740 impact pad component frame members
750 trumpet pipe
755 trumpet faceplate
800 turn buckle assembly
810 eyelet of turnbuckle
815 eyelet void, defined by eyelet 810
820 threaded adjustment rod of turnbuckle
830 turn bracket of turnbuckle
900 form saver for ring pin
910 ring pin
915 ring pin void, defined by and within ring pin 910
1000 insert rod
1100 road
1150 backfill area or area behind wall to backfill
1200 post tension cable These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

Referring to FIG. 1 a general embodiment 100 used on a base level comprises a modular retaining wall system comprising a retaining component 105, face or retaining wall, a buttress component 300, an impact pad 500 or reinforcing member, a foot component 400 and a trumpet pipe 750. The dashed line upon the buttress component depicts a section of the buttress that is removed or omitted to construct the second tier embodiment further described in FIG. 3.

The retaining component 105 may be attached perpendicularly to the foot component 400 or may be battered, attached an angle less than ninety degrees. The retaining component 105 may comprise a front side 110, a back side 120, a horizontal top edge 140 or ledge and a void to accept a trumpet pipe 750. The pipe trumpet may comprise a trumpet faceplate 755 found upon, near or adjacent to the slant edge 320 or slant face of the buttress component 300.

The buttress component 300 may comprise a flat bottom side 340, side walls 330, a slant edge or slant face 320, a top edge 140 and a void to accept a trumpet pipe 750. The buttress component may comprise a recess area, not shown, to allow the trumpet faceplate to be disposed in a vertical position to avoid a bend in an inserted cable.

The impact pad 500 or reinforcing member may comprise a triangle side surface 510, slanted exposed surface 520 and a void to accept the trumpet pipe 750.

Figure 2:
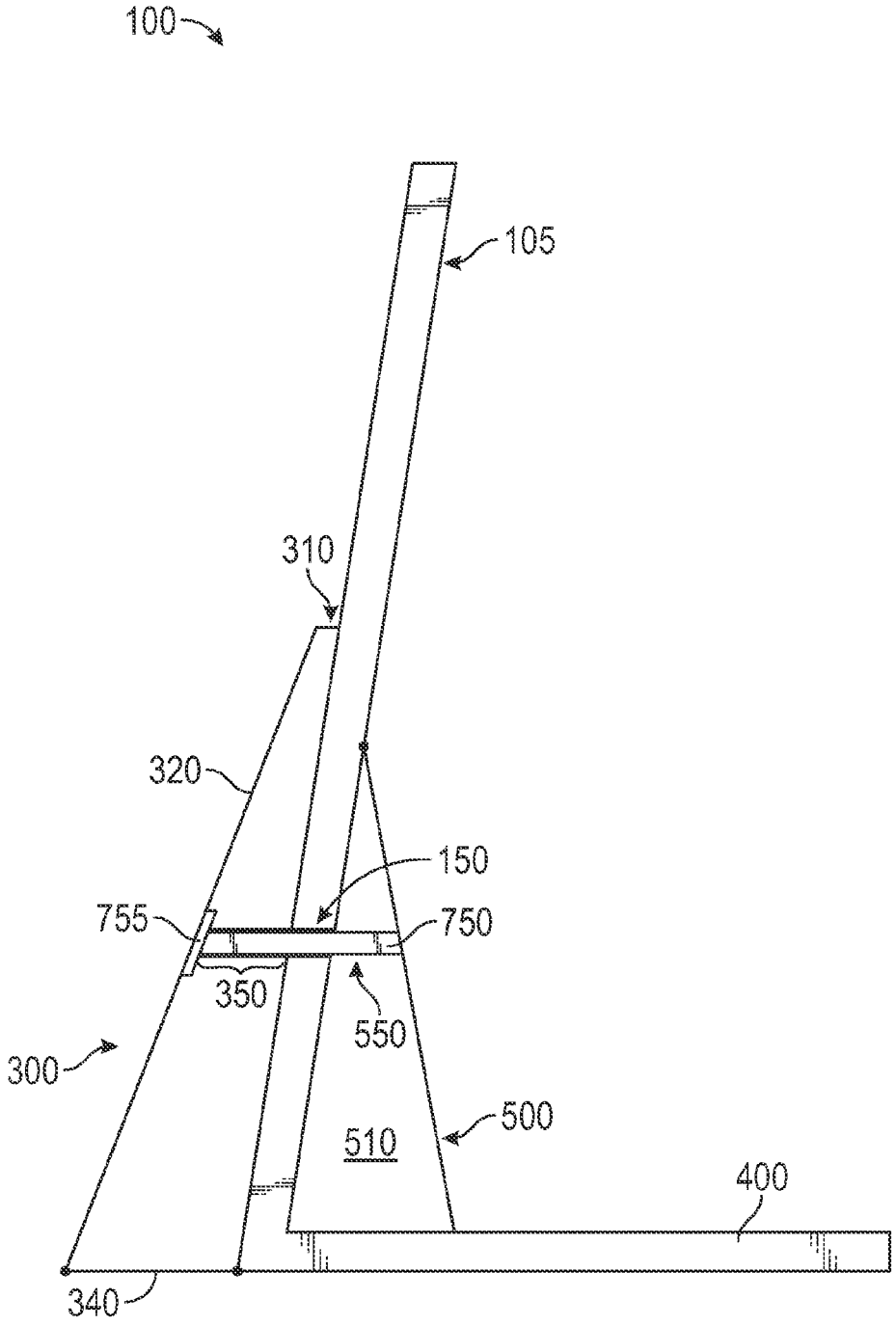
FIG. 2 depicts a sectional view of a disclosed embodiment for first tier applications

Referring to FIG. 2, a disclosed embodiment 100 is shown with a retaining component 105 having and defining a void 150 used to accept a pipe trumpet 750. The buttress component 300 may contain and define a void 350 used to accept a pipe trumpet 750. The impact pad 500 may contain and define a void 550 used to accept a pipe trumpet.

Figure 3:
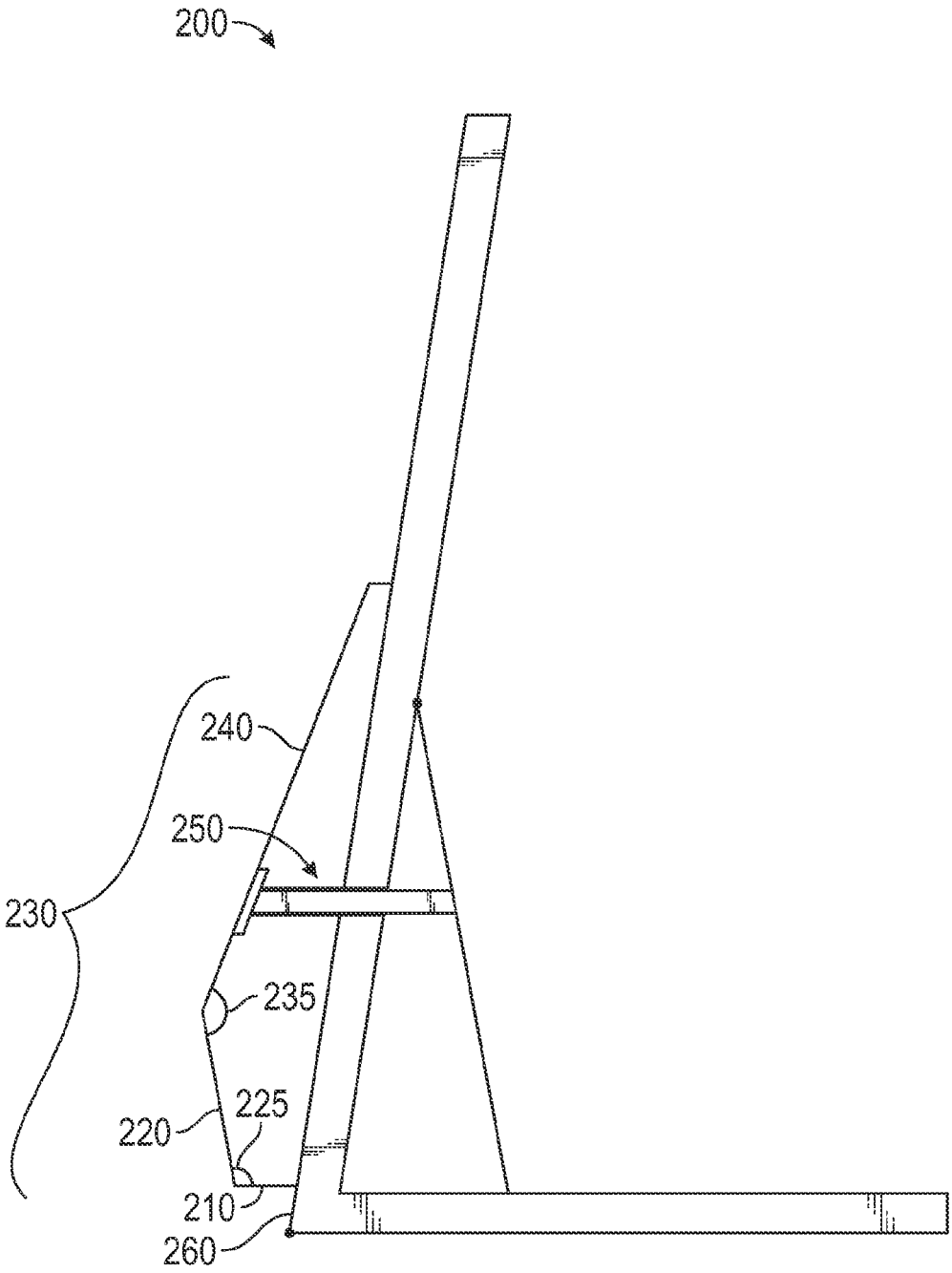
FIG. 3 depicts a sectional view of a disclosed embodiment used in upper tier applications

FIG. 3 depicts a second tier embodiment 200 that may be placed on top of the first embodiment. The second embodiment 200 may comprise a modified buttress component 230 comprising a raised lower footing 210 attached to an angled lower edge 220 with the angled lower edge 220 attached to a slant edge 240. The raised lower footing 210 may be attached at an angle 225 of between 100 degrees to 140 degrees. This angle 225 provides advantages in durability and in providing optimal mass to the buttress 230.

The angle 235 between the angled lower edge 220 and slant edge 240 may be between 130 degrees to 170 degrees. This angle 235 provides advantages in durability and in providing optimal mass to the buttress 230.

The second embodiment 200 features a lower exposed face section 260 of the retaining component. The lower exposed face section 260 provides an optimal attachment area the top section of a first tier or base level retaining component.

Figure 4:
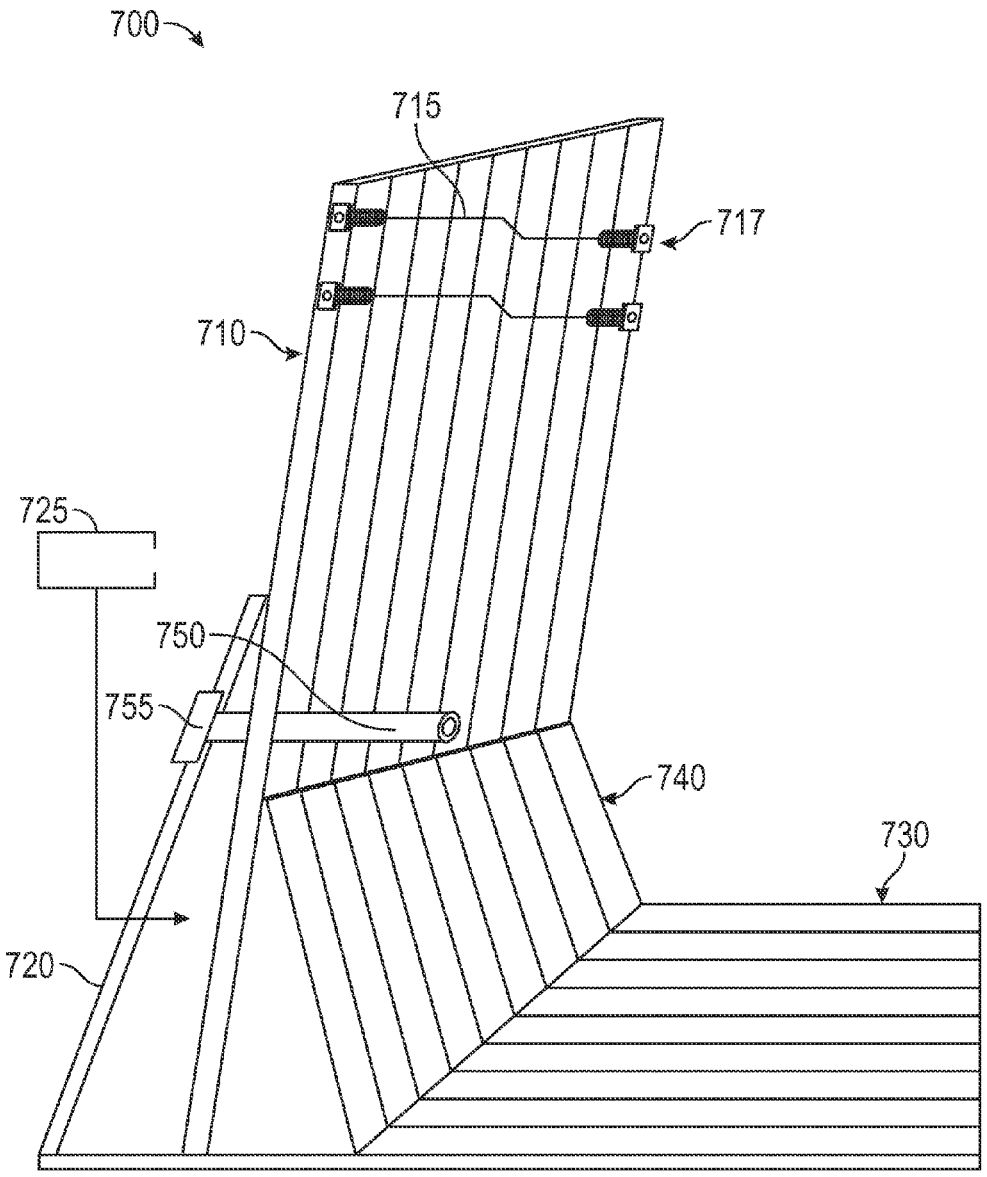
FIG. 4 depicts a reinforcement steel configuration

FIG. 4 depicts a reinforcement frame structure 700 that may be comprised of steel, metal or other solid material. The reinforcement frame structure may be used to create a post-tension concrete retaining wall system comprising the embodiments disclosed herein. The reinforcement frame structure 700 may comprise a plurality of retaining component frame members 710, attached to a plurality of impact pad component frame members 740, attached to a plurality of foot component frame members 730 attached to a plurality of buttress component frame members 720. A plurality of rebar stirrups or similar attachment components may further define the substructure of the buttress and may attach the buttress component frame members 720 to the retaining component frame members 710. The retaining component frame members 710 may comprise a plurality of Z shaped bar 715 with the ends of the Z shaped bar attached to form saver threaded components. The threaded components may retain pins as further described and illustrated herein.

The reinforcement frame structure 700 provides structural support for the system components, such may be made of concrete or similar materials. The longitudinal configuration of the reinforcement frame structure components allows the system to be easily transported to a job site. Upon arrival, the reinforcement frame structure components may be fastened together using zip ties, metal stirrups or other types of fasteners. Disclosed systems may also be fabricated off site.

Figure 5:
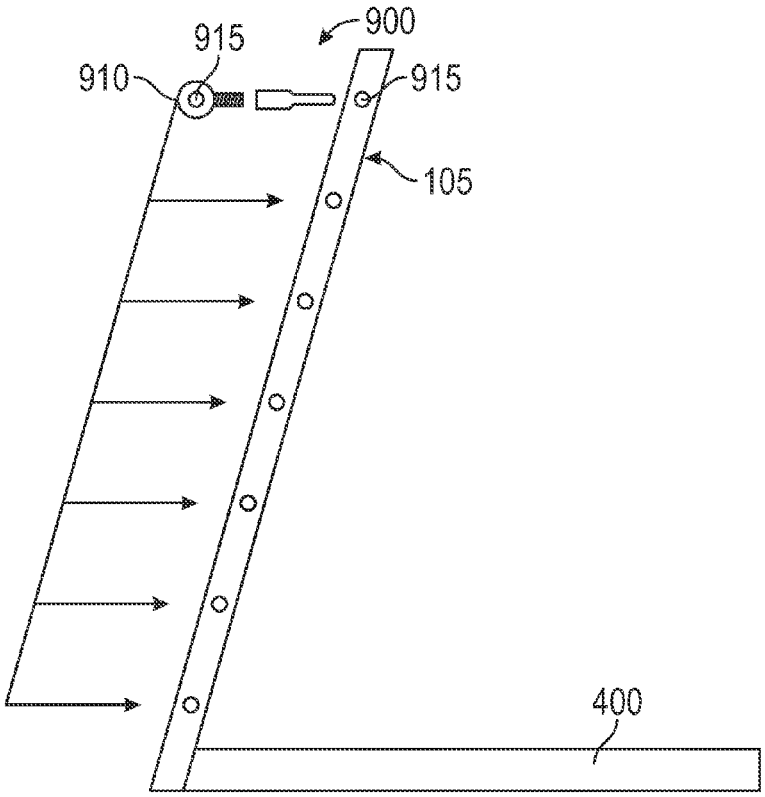
FIG. 5 depicts the application of form savers

FIG. 5 depicts a side view of a retaining component 105 attached to a foot component 400. A side edge of a retaining component 105 may comprise a plurality of voids 915 configured to accept form savers 900 with the form savers accepting ring pins. Or, form saver threated components, see FIG. 4 may be attached to Z shaped bar before concrete is poured to fabricate the retaining component. A multitude of means and methods are contemplated with respect to securing ring pins into the sides of the retaining component.

Figure 6:
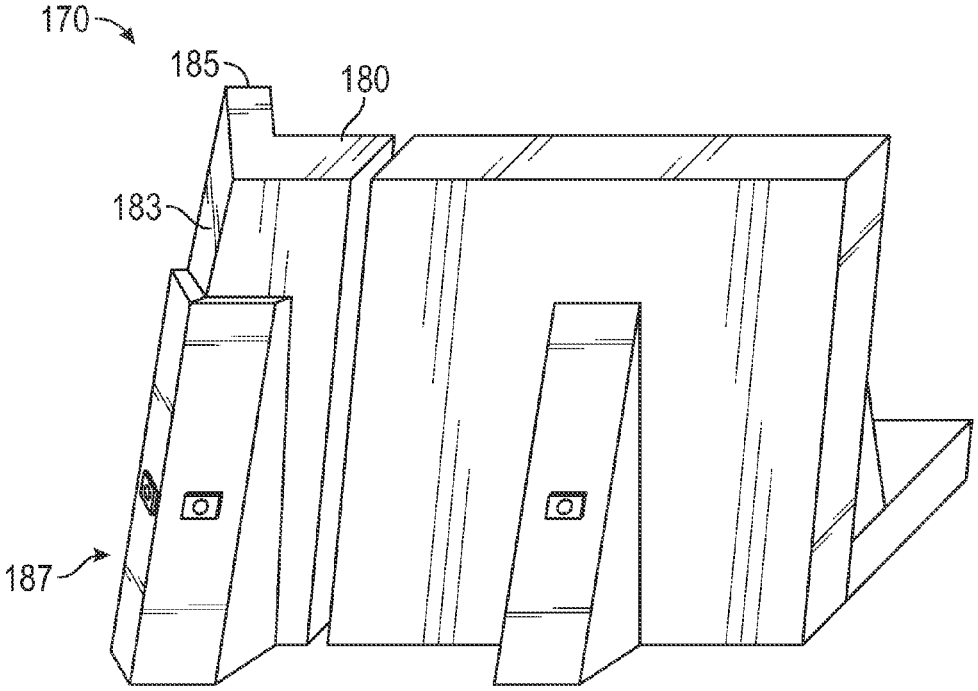
FIG. 6 depicts a corner embodiment

FIG. 6 depicts a corner embodiment 170 comprising a front facing component 180 attached or integrated with a return component 185. A vertical ridge 183 may define a transition point between the front facing component 180 and the return component 185. A buttress 187 may support both the front facing component 180 and the return component 185. The disclosed corner embodiment provides advantages in that the corners or end points of hill sides may be artfully retained. The buttress may also retain a retention system into the hillside as found with the main embodiment 100.

Figure 7:
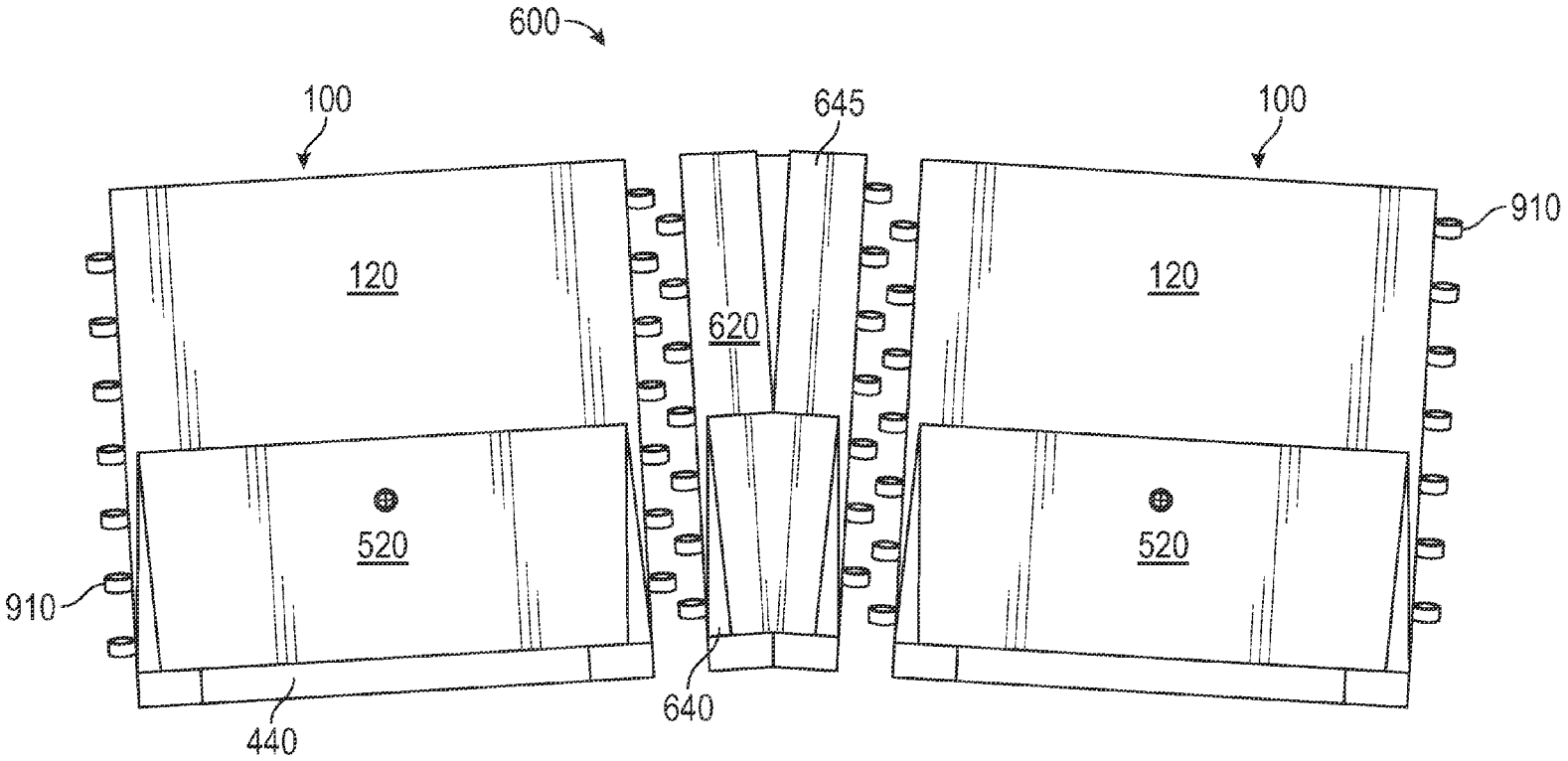
FIG. 7 depicts a back view of a disclosed system

FIG. 7 depicts a rear or back view of a wedge 600 flanked by two first embodiments 100. The wedge 600 is orientated with the larger or wider end 645 on top and the narrower end 640 on bottom. This configuration is suited to adapt to downward lateral slopes occupied by or otherwise retained by ground level first embodiments 100. The orientation of the wedge would be reversed to conform to a bottom part of a lateral slope.

Figure 8A:
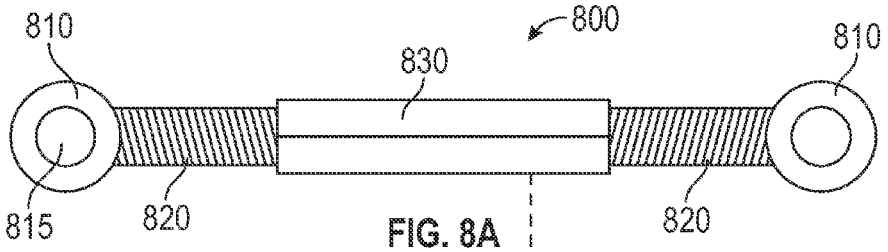
FIG. 8A depicts a turnbuckle

FIG. 8A depicts a turnbuckle assembly 800 comprising a turn bracket 830 threaded to a pair of threaded adjustment rods 820. The distal portion of each threaded adjustment rod is attached to an eyelet 810 and each eyelet defines an eyelet void 815.

Figure 8B:
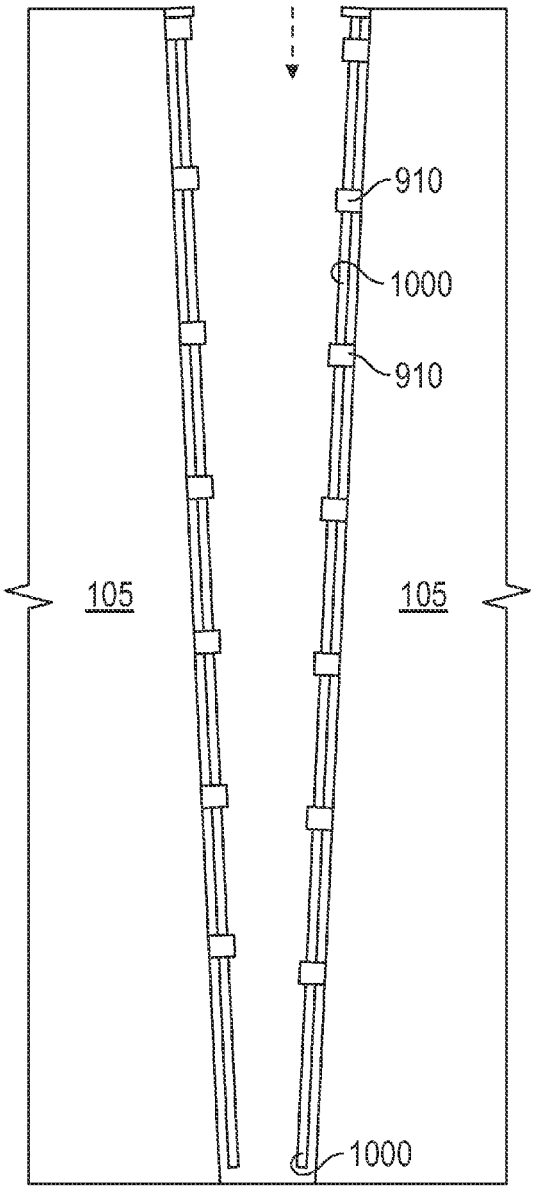
FIG. 8B depicts a pin ring, turnbuckle and insert rod assembly

FIG. 8B depicts an insert rod 1000 inserted into a plurality of ring pins 910 with the ring pins attached to a retaining component 105. The two retaining components 105 are shown to be unleveled in order to comport with surrounding topography. In lieu of a wedge, the two retaining components are attached to one another by use of a turn buckle assembly 800. A plurality of turn buckle assemblies may be attached to the insert rods in areas between the ring pins 910. In this application, the ring pins may be staggered so as to not touch one another when the two walls are close to one another. Thus, the insert rod 1000 may be inserted into a plurality of eyelet voids 815 of the turnbuckles and inserted into a plurality of ring pins 910 of a retaining member. The turn bracket 830 of each turn buckle may be rotated so that the length of each threaded adjustment rod 820 comports to the desired or set distance between retaining components or retaining walls.

Figure 9:
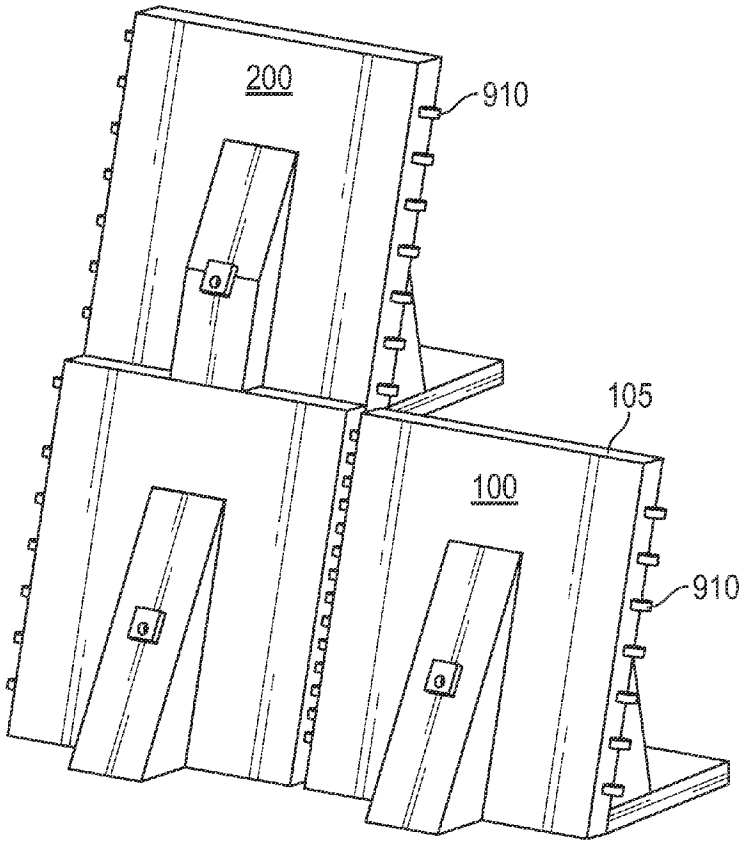
FIG. 9 depicts a multi-tier configuration

FIG. 9 depicts a second tier embodiment 200 disposed upon a first tier, ground level or general embodiment 100.

Figure 10:
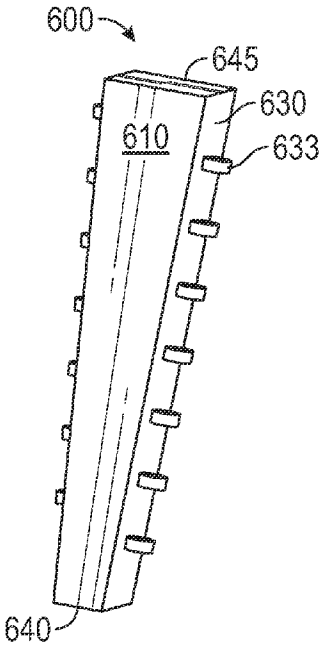
FIG. 10 depicts a wedge connector

FIG. 10 depicts a wedge connector 600 comprising a plurality of pin rings 633 attached upon or into an angled side surface 630. A wedge connector may have a wide end 645 and a narrow end 640 to comport with topography.

Figure 11:
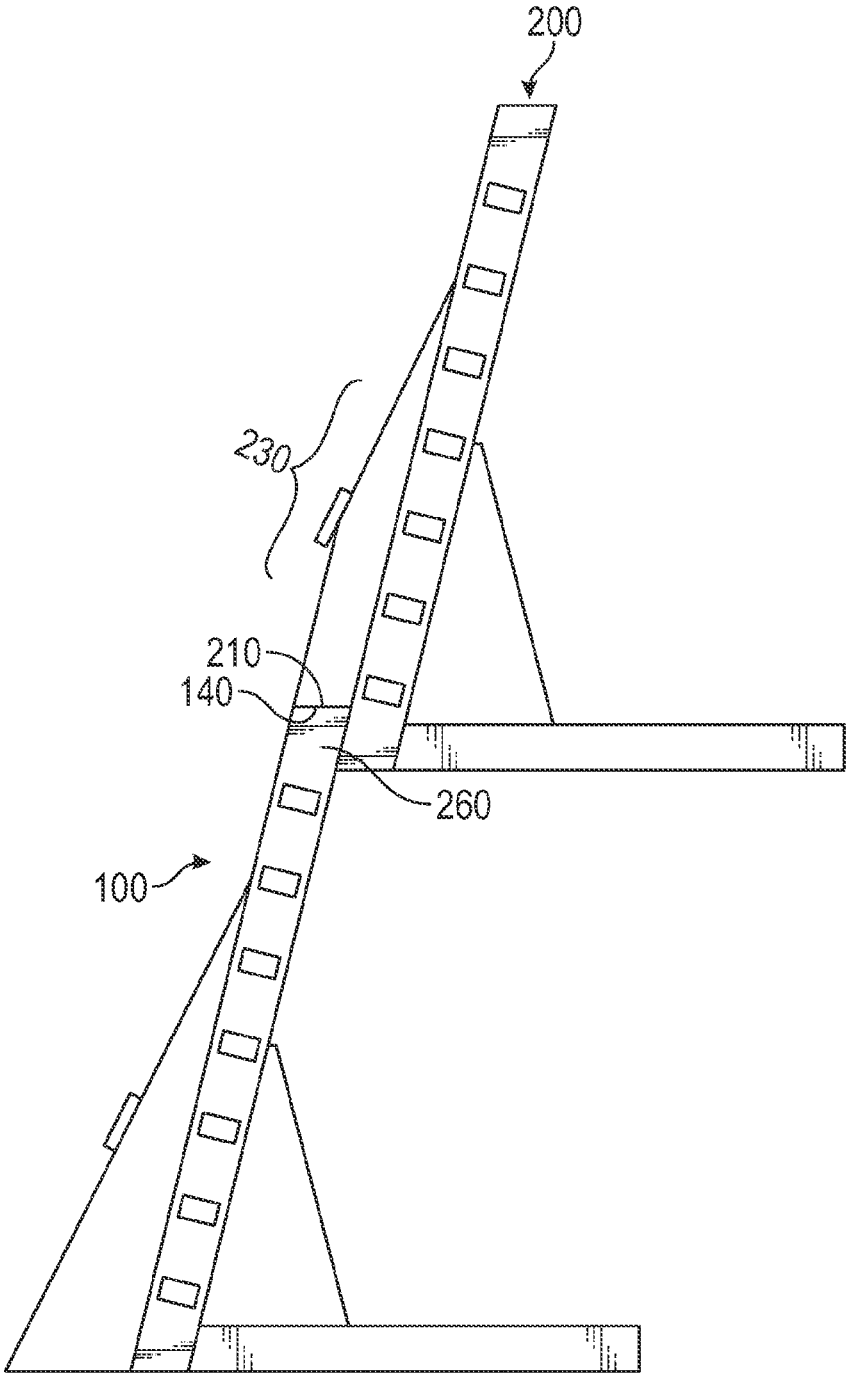
FIG. 11 depicts a side view of multi-tier configuration

FIG. 11 depicts a side or elevation view of a second tier embodiment 200 disposed upon a first tier, ground level or general embodiment 100. This configuration has advantages as the top portion or horizontal top edge 140 of the bottom embodiment 100 fits securely into or adjacent to the lower exposed face 260 of the second tier embodiment and the raised lower footing 210 of the buttress component 230 of the second tier embodiment 200. This unique configuration or attachment assembly also allows the second tier unit 200 to be disposed further into the hill or slope as compared to the first tier unit that is disposed outwardly toward the toe of a hill. The unique configuration or attachment assembly also leverages the structural strength of the buttress component 230 of the second tier embodiment.

Figure 12:
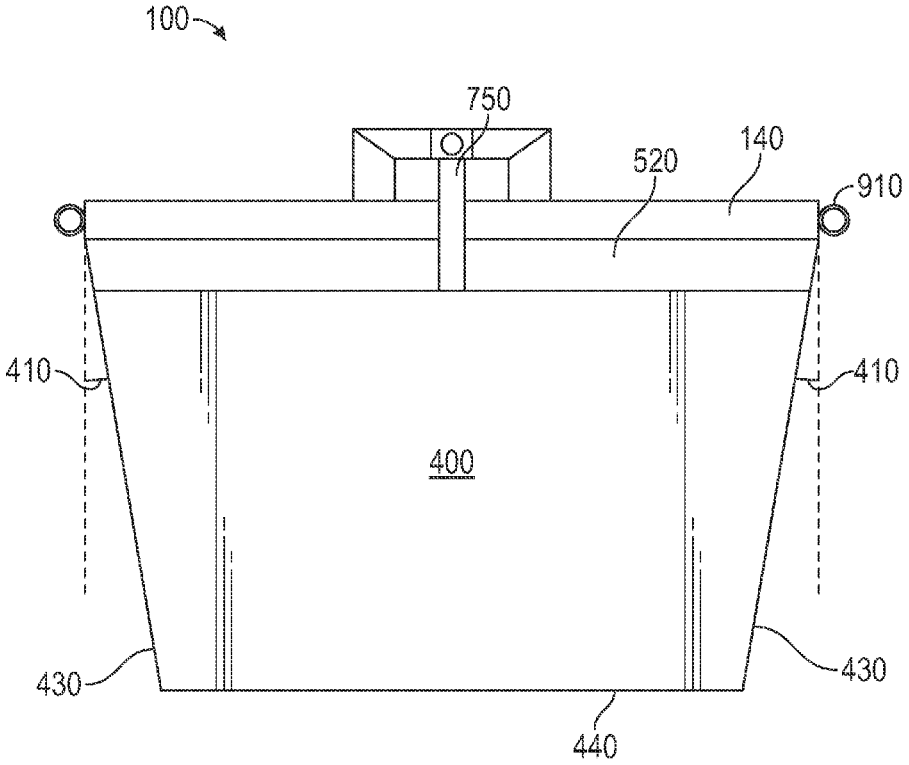
FIG. 12 depicts a top sectional view of a disclosed embodiment

FIG. 12 is a top plan sectional view of a general embodiment 100 and features a view of the angled side edges 430 of the foot component 400. The inward angle 410 of the angled side edges is in the range of 10 to 30 degrees. This range of inward angle 410 provides advantages in allowing the disclosed embodiments or retaining wall structures to be placed side by side in an arched formation. Thus, the disclosed embodiments may be used to retain slopes having an arched or circular toe area. FIG. 12 also depicts a trumpet pipe 750, a horizontal top edge 140 of a retaining component, a ring pin 910, a slanted exposed surface 520 of an impact pad and a back side edge 440 of a foot component 400.

Figure 13A:
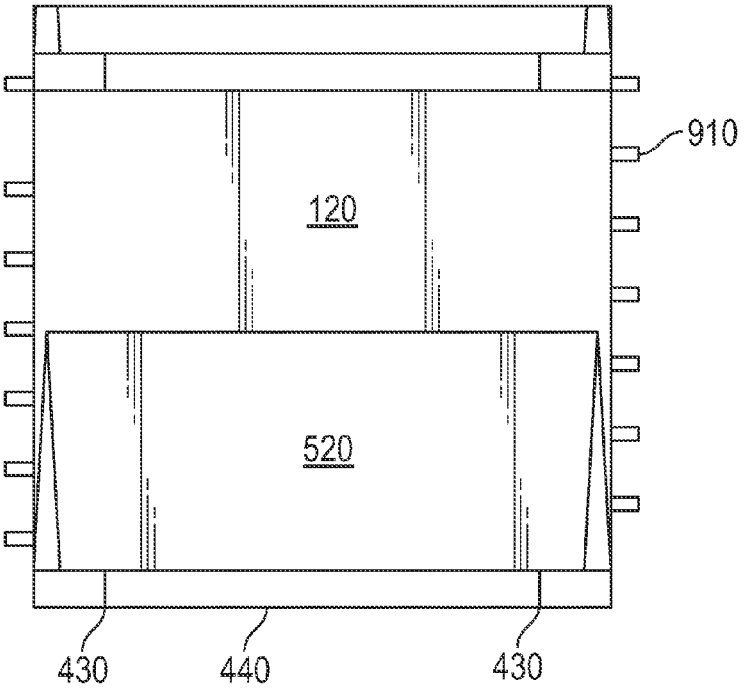
FIG. 13A depicts a rear elevation view of a disclosed embodiment

FIG. 13A depicts a rear elevation view of a disclosed embodiment comprising a plurality of ring pins 910, a back side 120 of a retaining component, a slanted exposed surface 520 of an impact pad, a pair of angled side edges 430 of a foot component and a back side edge 440 of a foot component.

Figure 13B:
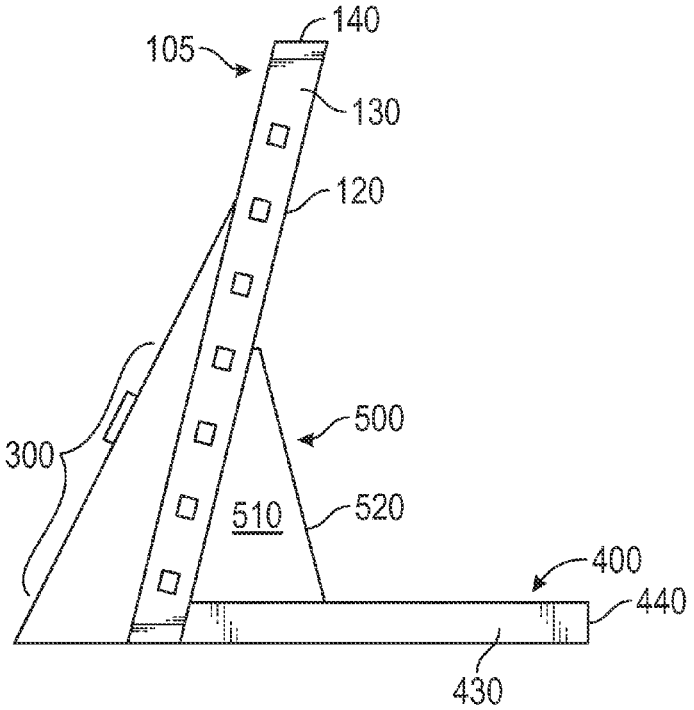
FIG. 13B depicts a side view of a disclosed embodiment

FIG. 13B depicts a side elevation view of a disclosed embodiment comprising a buttress component 300, a retaining component 105, a plurality of ring pins 910 attached to or within a the vertical sides 130 or lateral sides of retaining component, a back side 120 of the retaining component, an impact pad 500 comprising a triangle side surface 510 and a slanted exposed surface 520 and a foot component 400 comprising an angled side edge 430 and a back side edge 440.

Figure 14A:
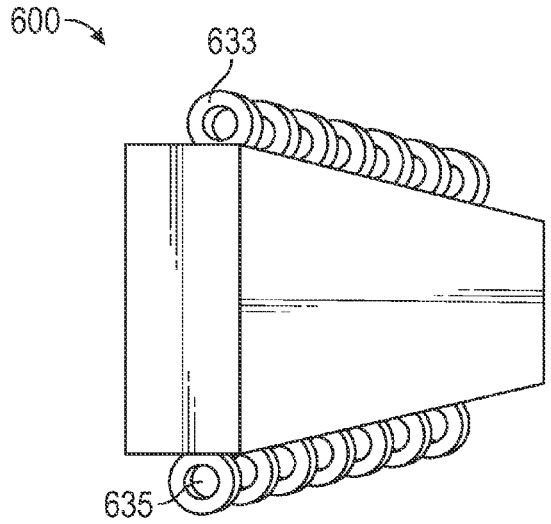
FIG. 14A depicts a perspective view of a wedge connector

FIG. 14A depicts a perspective view of a wedge connector 600 comprising a plurality of pin rings 633 with each pin ring defining a pin ring void 635.

Figure 14B:
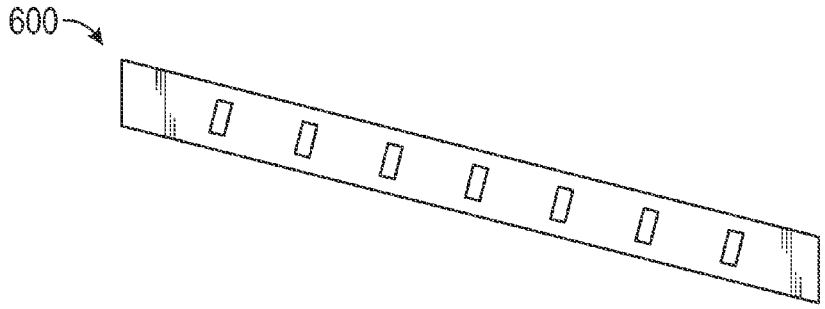
FIG. 14B depicts a side view of a wedge connector

FIG. 14B depicts a side view of a wedge connector 600.

Figure 14C:
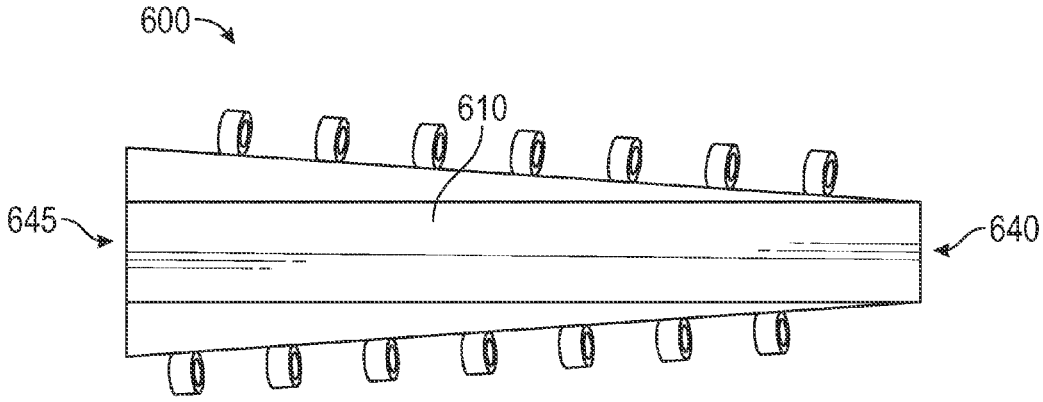
FIG. 14C depicts a wedge connector

FIG. 14C depicts a side view of a wedge connector 600 comprising a larger end 645 and a narrow end 640.

Figure 15:
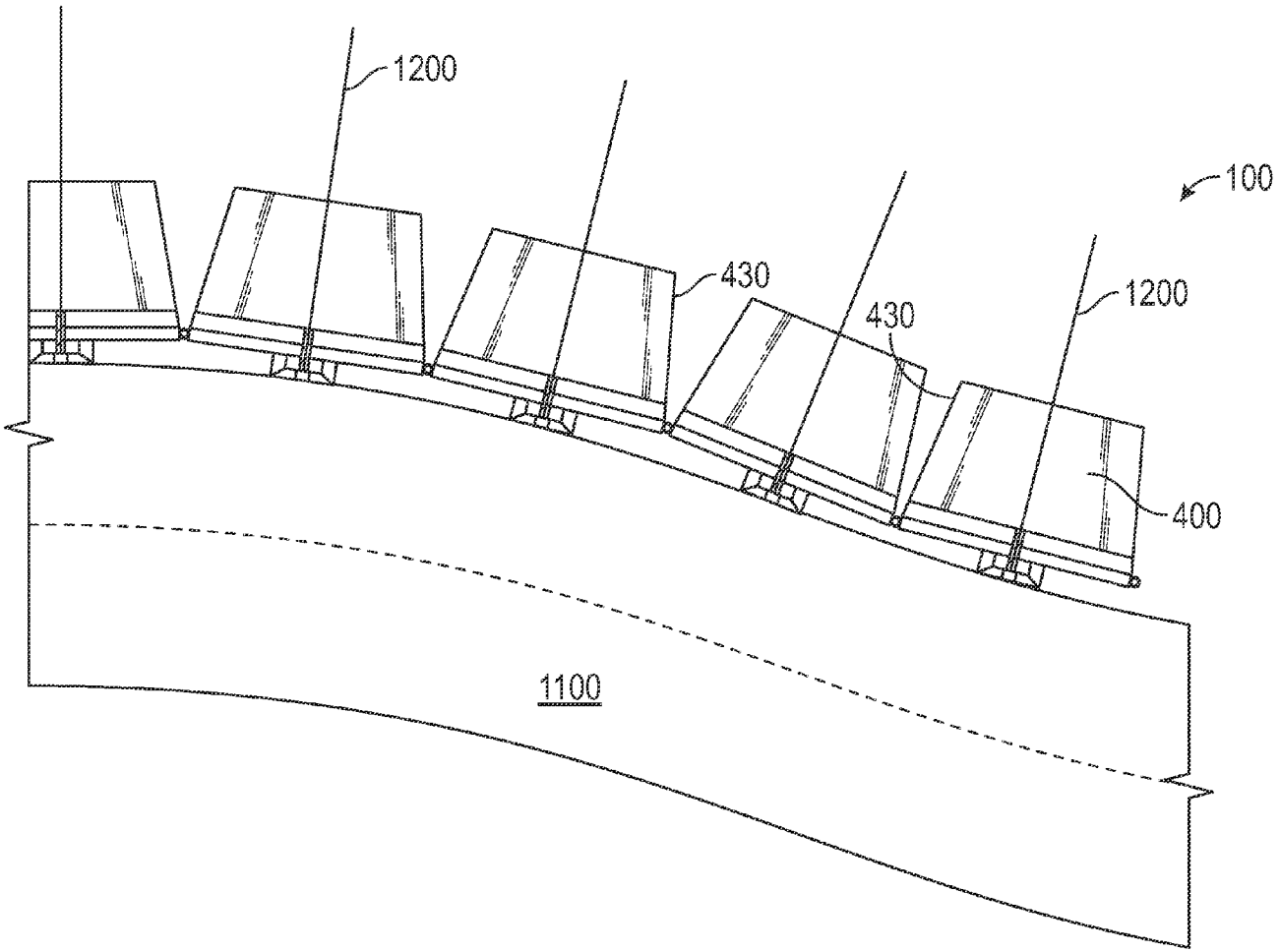
FIG. 15 depicts a plurality of disclosed embodiments used in a road support system

FIG. 15 depicts a plurality of disclosed embodiments 100 or modular retaining wall systems disposed side by side within a hill and adjacent to a curved road 1100. The versatility of the disclosed embodiments is greatly enhanced each foot component 400 having angled side edges 430. The angled side edges allow the modular retaining wall systems to be placed in both convex and concave configurations to adapt to both inside and outside road curves.

Each retaining wall system may comprise or use a cable or post tension cable 1200 that runs through the trumpet pipe and into the hillside. The sturdy configuration of each buttress assists in dissipating the tension of the cable into the rest of the wall system.

Figure 16:
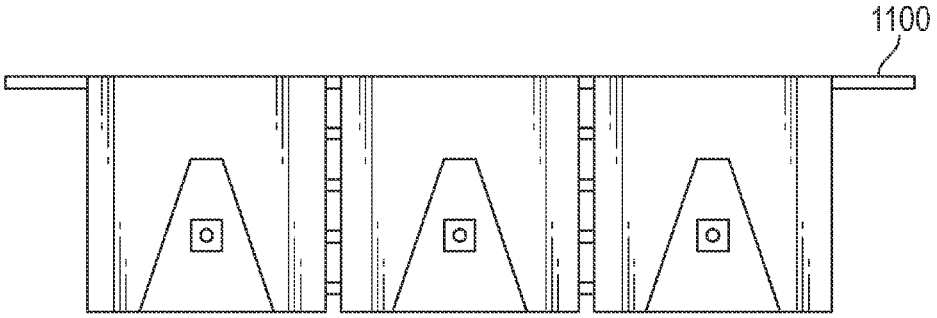
FIG. 16 depicts a front view of a plurality of disclosed embodiments supporting a road

FIG. 16 depicts a front elevation view of several retaining walls placed side by side and used to support a roadway.

Figure 17:
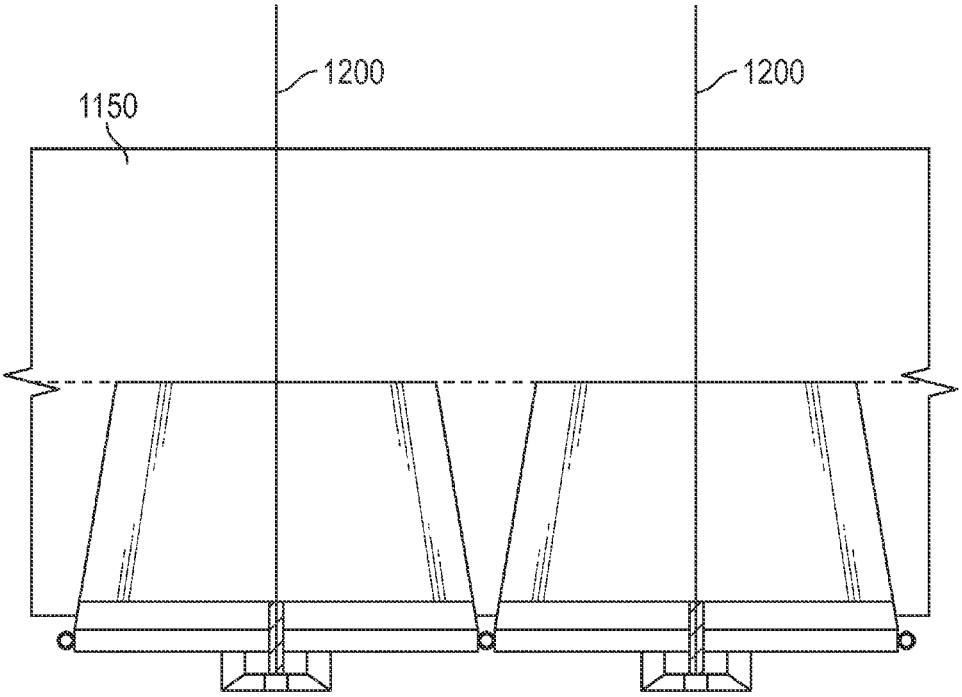
FIG. 17 depicts a top sectional view of two disclosed embodiments ready to accept backfill

FIG. 17 depicts a top sectional view of two disclosed wall systems. A post tension cable is shown in connection with a buttress. A backfill area 1150 may accept native or imported soil. Such a configuration is usefull for road repair wherein soil has been washed away.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

Items

1. A modular retaining wall system 100, the system comprising a) a reinforcement frame structure 700 comprising:

a plurality of retaining component frame members 710 attached to a plurality of impact component frame members 740 attached to a plurality of foot component frame members attached to a plurality of buttress component frame members 720;

concrete attached to and within the reinforcement frame structure to comprise:

b) a foot component 400 comprising angled side edges 430, a back side edge 440, a front area, opposite the back side edge, the front area attached to an impact pad 500 and a retaining component 105, the impact pad comprising a slanted exposed surface 520 and a pair of triangle side surfaces 510, the retaining component comprising a horizontal top edge 140, a back side 120, a front side 110 and a pair of vertical sides 130 with the vertical sides attached to a plurality of ring pins;

c) a buttress component 300 attached to the retaining component, the buttress component comprising a flat bottom side 340, a pair of side walls 330 and a slant edge 320.

2. The modular retaining wall system of 1 further comprising:

a trumpet pipe 750 attached to the retaining component frame members within the plurality of buttress component frame members and a trumpet face plate 755 attached to the trumpet pipe.

3. The modular retaining wall system of 1 further comprising a plurality of rebar stirrups 725 attached to the buttress component frame members and the retaining component frame members.

4. The modular retaining wall system of 1 further comprising a plurality of Z shaped bar components 715 attached to the retaining component frame members.

5. The modular retaining wall system of 4 further comprising form saver threaded components 717 attached to the plurality of Z shaped bar members.

6. The modular retaining wall system of 5 further comprising ring pins 910 threaded into each form saver threaded component with each ring pin comprising and defining a ring pin void 915.

7. The modular retaining wall system of 6 wherein the pair of angled side edges of the foot component have an inward angle 410 in the range of 10 to 30 degrees.

8. A second tier modular retaining wall system 200, the system comprising:

a) a reinforcement frame structure 700 comprising:

a plurality of retaining component frame members 710 attached to a plurality of impact component frame members 740 attached to a plurality of foot component frame members attached to a plurality of buttress component frame members 720;

concrete attached to and within the reinforcement frame structure to comprise:

a foot component 400 attached to impact pad 500 and a retaining component 105;

the retaining component attached to a buttress component 230, the buttress component comprising a raised lower footing 210, an angled lower edge 220 and a slant edge 240.

9. The system of 8 further comprising an angle 225 between the raised lower footing and the angled lower edge in the range of 110 to 140 degrees.

10. The system of 9 further comprising an angle 235 between the angled lower edge 220 and the slant edge 240 in the range of 120 to 160 degrees.

11. The system of 10 further comprising a lower exposed face 260 of the retaining component, the lower exposed face connected to the raised lower footing of the buttress.

12. A wedge connector 600 comprising a front surface 610, a back surface 620 a pair of side surfaces 630 with the side surfaces connected to a plurality of pin rings 633 with each pin ring comprising and defining a pin ring void 635, the wedge connecter further comprising a smaller end 640 and a larger end 645.

13. The wedge connector of 12 attached to a modular retaining wall system 100 with the pin rings of each component retained by an insert rod 1000.

What is claimed is:

1. A modular retaining wall system, the system comprising a) a reinforcement frame structure, that is left in place as part of the modular retaining wall system, the reinforcement frame structure comprising:

a plurality of retaining component frame members attached to a plurality of impact component frame members attached to a plurality of foot component frame members attached to a plurality of buttress component frame members;

concrete attached to and within the reinforcement frame structure to comprise:

b) a foot component comprising angled side edges, a back side edge, a front area opposite the back side edge, the front area attached to an impact pad and a retaining component, the impact pad comprising a slanted exposed surface and a pair of triangle side surfaces, the retaining component comprising a horizontal top edge, a back side, a front side and a pair of vertical sides with the vertical sides attached to a plurality of ring pins, with the ring pins attached to the concrete;

c) a buttress component attached to the retaining component, the buttress component comprising a flat bottom side, a pair of side walls and a slant edge;

d) a trumpet pip attached to the retaining component frame members within the plurality of buttress component frame members and a trumpet face plate attached to the trumpet pipe;

e) a plurality of rebar stirrups attached to the buttress component frame members and the retaining component frame members; and f) a plurality of Z shaped bar components attached to the retaining component frame members.

2. The modular retaining wall system of claim 1 further comprising form saver threaded components attached to the plurality of Z shaped bar members.

3. The modular retaining wall system of claim 2 wherein the ring pins are threaded into each form saver threaded component with each ring pin comprising and defining a ring pin void.

4. The modular retaining wall system of claim 3 wherein the pair of angled side edges of the foot component have an inward angle in the range of 10 to 30 degrees.

* * * * *